United States Patent [19]

Annis et al.

[11] Patent Number: 4,481,655

[45] Date of Patent: Nov. 6, 1984

[54] X-RAY TARGET ATTACHMENT

[75] Inventors: Jeffrey R. Annis, Waukesha; Srinivasa R. Gowda, Milwaukee, both of Wis.

[73] Assignee: General Electric Company, Schenectady, N.Y.

[21] Appl. No.: 394,081

[22] Filed: Jul. 1, 1982

Related U.S. Application Data

[63] Continuation-in-part of Ser. No. 364,568, Apr. 1, 1982, abandoned.

[51] Int. Cl.[3] ..... H01J 35/04

[52] U.S. Cl. ..... 378/125; 378/144

[58] Field of Search ..... 378/144, 125, 127, 128, 378/129, 130, 131, 132, 133

[56] References Cited

U.S. PATENT DOCUMENTS

| | | | |
|---|---|---|---|
| 3,795,832 | 3/1974 | Holland | 378/144 |
| 4,276,493 | 6/1981 | Srinivasa | 378/144 |

*Primary Examiner*—Craig E. Church

*Attorney, Agent, or Firm*—Fuller, House & Hohenfeldt

[57] ABSTRACT

A metal nut for clamping a metal or nonmetal x-ray target to a metal anode stem or a rotating anode x-ray tube. The nut body is basically circular and has an axial threaded hole. The body has an axially extending cylindrical portion that is contiguous with a generally convex portion on one side of the cylindrical portion and is concave on the other side. The concavity is surrounded by an annular land for transmitting compressive force to the target. A cross-section of the nut simulates a beam that is thickest axially adjacent the central threaded hole and decreases in thickness symmetrically radially away from the center so it will flex when tightened at room temperature and have residual force stored when hot to compensate the metals for thermal creep.

15 Claims, 5 Drawing Figures

X-RAY TARGET ATTACHMENT

BACKGROUND OF THE INVENTION

This application is a continuation-in-part of application Ser. No. 364,568, filed Apr. 1, 1982 now abandoned.

This invention pertains to means for fastening parts for negating and resisting the effects of creep which occurs in metals as a result of thermal cycling.

An important use of the invention is for attaching graphite and metal targets to the stem of the rotor in a rotating anode x-ray tube. The features of the invention will be demonstrated herein in connection with such use.

Targets principally of graphite have advantages over refractory metal targets. Graphite has lower mass and can be accelerated from 0 to 10,000 rpm, for example, in as little as $\frac{1}{3}$ of the time that it takes a metal target of equal thermal capacity to be accelerated to the speed range. A graphite target, when properly mounted, has good resistance to thermal shock. It has high heat storage capacity compared to common refractory metals and its thermal emissivity is almost as good as that of a theoretical black body.

One of the reasons why graphite targets have not been used extensively in x-ray tubes, despite the foregoing and other advantages, is that no fully satisfactory solution has been found heretofore to the problem of preventing loosening of the target on the stem of and anode rotor after the target has undergone one or more thermal cycles. During a normal x-ray exposure sequence, the body of the graphite target may change from room temperature to as high as 1250° C. in about 5 or 10 seconds depending upon the exposure technique being used. Much of the heat developed in the target due to dissipation of the electron beam energy is, of course, radiated to the surrounding environment of the x-ray tube. However, the metal rotor stem on which the target is mounted conducts considerable heat and may undergo thermal cycling in the range of room temperature to 1250° C. and then back to room temperature again.

Various devices have been used for clamping a graphite target to the anode rotor stem. Most commonly, the stem is threaded and a nut and expansion-compensating washers are used for providing the target clamping force. When a nut is used, care must be taken not to tighten it to such extent that the compressive strength of graphite will be exceeded. The maximum permissible stress for graphite targets is in the range of about 6000 to 8000 psi. Hence, the load or compressive force developed with the nut must necessarily be under the maximum allowable stress with some reasonable margin of safety.

The coefficients of expansion of graphite and typical metals out of which nuts are made are such that when the target and nut are at room temperature they will be in force equilibrium. Because the target and nut heat and expand differentially, little or no clamping force will remain at 1250° C. One or two mils of radial looseness can cause the rotating target to vibrate which results in noise and sometimes in fracture and destruction of the x-ray tube.

Applicants have observed that thermal creep is an even more significant factor in the nut loosening process in fastening of graphite and metal targets to anode stems. Any material at a high temperature under constant load will creep or physically yield and will not return to its original dimensions when the temperature is dropped. Thermal creep is a function of temperature and the stress or load imposed on the material. The anode stem, its threads and the target clamping nut undergoes substantial thermal creep or permanent deformation in the worst case where the combination of these parts must go through many thermal cycles between room temperature and 1250° C. or more. In the graphite target case, for example, even though the initial compressive stress imposed on the graphite by a clamping nut does not exceed the 6000 or so psi allowable maximum stress, stresses on the stem and its threads may at the same time reach 30,000 psi or more. Stresses at this level will cause significant creep in the stem at target operating temperatures.

It has been proposed to use any of the variety of available self-locking nuts to clamp the graphite and metal targets. Typical self-locking nuts are shown in U.S. Pat. Nos. 1,734,445; 1,774,081; 3,177,914; and 4,043,369. The nuts shown in these patents are usually notched or provided with radial slots such that when the nut is tightened down it is bowed radially inwardly for its internal thread to grip the external thread on which the nut is screwed. These and other prior art nuts are, indeed, suitable for constant temperature applications but they are incompatible with the materials used and environment that prevails in graphite and metal target x-ray tubes. Simply having the internal thread of a nut deformed radially inwardly to obtain greater gripping force on an external thread will not compensate for thermal creep in the axial direction of the nut and stem. Such is true even with the nut shown in U.S. Pat. No. 1,734,445. It is a castellated nut which has a dished bottom surface where it interfaces with the object that is being tightened down. When it is tightened, the sides of the nut bend inwardly to grip the stud thread. A rather high initial breakaway torque is required to loosen the nut under ordinary circumstances, that is, when it has not been subjected to thermal cycling. If it has been very hot, particularly to the degree which occurs in an x-ray tube, it will not compensate for creep or permanent plastic deformation and will loosen by itself.

SUMMARY OF THE INVENTION

An object of the present invention is to provide a nut that solves the difficult problem of compensating for the effects of thermal creep when the nut is used to clamp a graphite x-ray target on a rotating anode stem and is also useful to clamp a metal target to an anode stem to compensate for thermal creep.

More specific objects of the invention are to provide a nut adapted for being pre-stressed and deflected when it is first tightened onto a target and which maintains sufficient deflection to keep a substantial compressive force applied to the target when it is cold or hot.

Briefly stated, the components involved in the illustrated embodiment of the invention are a graphite x-ray tube target, a rotating anode stem on which the target is mounted, and a novel nut for clamping the target to the stem. The invention applies to a metal target too. The stem and nut metals have high melting points, low vapor pressure at x-ray tube operating temperatures, thermal expansion properties compatible with the metallic or non-metallic substrate of the target, and maintenance of strength at high temperatures with negligible thermal creep. Care must be taken to avoid metals that may have most of the recited desirable properties but have poor high temperature creep resistance. Examples of some suitable metals will be given later.

A preferred configuration of the nut is where it comprises a body that is cylindrical over part of its axial length. On one side of the cylindrical portion, the nut body decreases in thickness radially outwardly from its center and has a conical or convex shape. On the other or rear side, that is, the side that interfaces with the target that is being clamped to the stem, it has a concavity that is conical or curved. The concave region on the rear side of the nut is surrounded by a flat annular surface or land over which compressive force is transmitted from the nut to the target body. A cross-section of the nut simulates a beam which is thickest adjacent the threaded hole of the nut and is thinnest near its periphery. When the nut is tightened it deflects axially by an amount sufficient for it to retain some deflection and sufficient residual force to continue deflection and maintain compressive force on the target even though the anode stem and nut have experienced creep due to being extremely hot previously.

How the foregoing and other more specific objects of the invention are achieved will be evident in the ensuing more detailed description of a preferred embodiment of the invention which will now be set forth in reference to the drawings.

DESCRIPTION OF A PREFERRED EMBODIMENT

Figure 1:
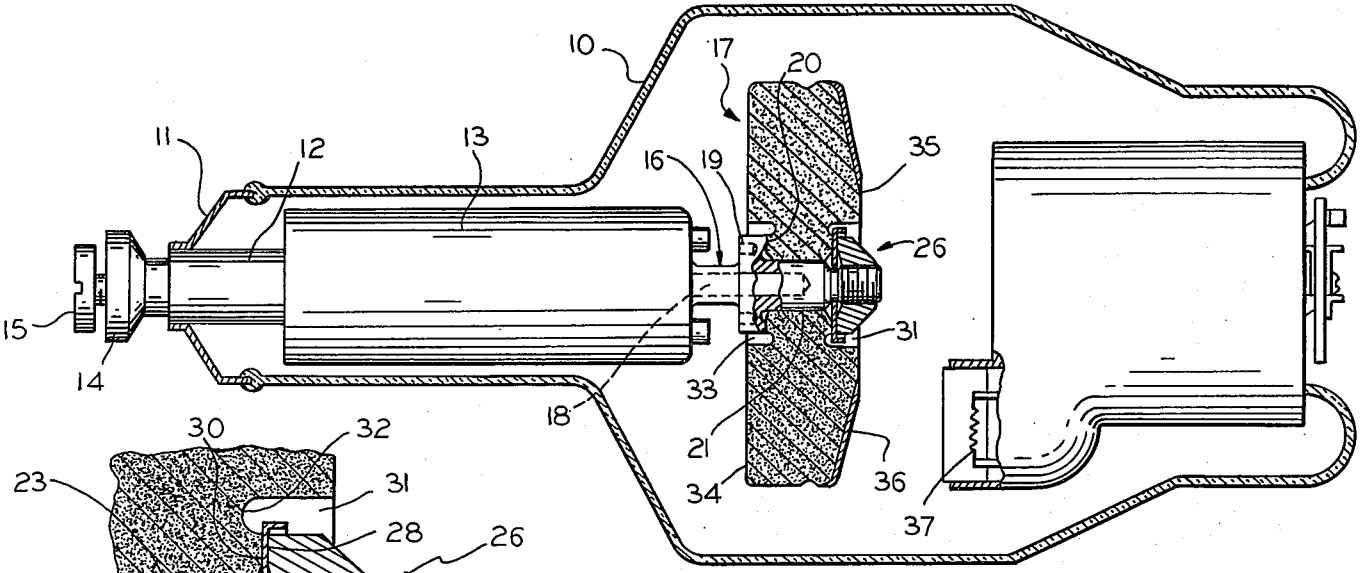
FIG. 1 shows a typical rotating anode x-ray tube that is provided with a graphite target and the new nut for clamping the target on the stem of the rotor.

FIG. 1 shows a typical rotating anode x-ray tube in which the new creep resistant target clamping means may be employed. The tube comprises a glass envelope 10 which has a ferrule 11 sealed in one end. The ferrule supports a stationary shaft 12 on which a cylindrical sleeve 13, which is actually the rotor of an induction motor, is journaled for rotation. A connector 14 extends from shaft 12 and there is a screw 15 for mounting the tube in its casing and for attaching a high voltage lead to the rotor assembly.

A stem 16 projects axially from rotor 13 and the x-ray tube target 17 of graphite in this embodiment is mounted and clamped on this stem. The stem must be a metal that has the desired properties indicated earlier. Availability and cost can affect the choice in a practical case. In an actual embodiment, a carbon-deoxidized molybdenum-based alloy formed with the vacuum arc casting process is used for stem 16. The alloy used is known in the trade as TZM and is available from several manufacturers of alloys. TZM is typically composed of no less than 99.25% of molybdenum up to 99.4%, 0.4–0.55% titanium and about 0.06 to 0.12% of zirconium. The remainder of about 0.3% is made up of controlled impurities such as carbon, iron, nickel, silicon, oxygen, hydrogen and nitrogen. TZM has good high temperature strength, thermal conductivity and expansion properties and low vapor pressure at high temperature, thus making it ideal for use in the hot high vacuum environment in an x-ray tube.

Several other metals can be used for the stem 16 and the new target clamping nut that is to be described to provide a creep negating combination. Examples are molybdenum and its alloys such as alloyed with tungsten, tantalum-tungsten alloys, zirconium by itself or alloyed, titanium-zirconium alloy containing a small amount of carbon known by the tradename TZC and more expensive metals such as rhenium and molybdenum-rhenium alloys. Skilled designers will understand that it is desirable to make the stem and nut, and a washer if a separate one is used, out of the same material as this simplifies stress calculations.

Figure 2:
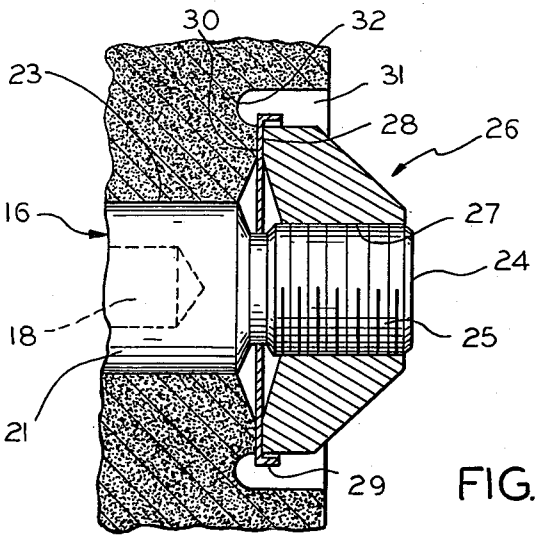
FIG. 2 shows an enlarged fragment of the target and an enlarged sectional view of the thermal creep compensating nut.

Stem 16 is preferably provided with an axial counterbore 18 to reduce its cross-section and thereby reduce heat conduction to the bearings, not shown, of anode rotor 13. The stem has an integral radial flange 19 that provides a shoulder or stop element 20 against which graphite target 17 is clamped. An enlarged portion 21 of the stem extends through a central hole 23 in graphite target 17. As can be seen particularly well in FIG. 2, the stem terminates in an integral diametrically reduced portion 24 which has an external thread 25.

The new thermal creep resistant nut for clamping the target to the rotor stem is indicated generally by the reference numeral 26. Its central hole has an internal thread 27 which is complementary to external thread 25 on the target supporting stem. The significant structural and functional characteristics of creep resistant nut 26 will be discussed in detail later. For the time being it is sufficient to observe in FIG. 2 that when nut 26 is tightened onto thread 25 of the rotor stem, an annular surface or land 28 on the rear of the nut will transmit a force through an intervening washer 29 to an annular riser portion or land 30 on the graphite target 17 to thereby clamp the target against radial shoulder 20 on flange 19 of the stem. The front face of the target has a counterbore 31 which provides clearance around nut 26 and is rounded at its bottom around its periphery as indicated at 32 for the purpose of avoiding the stress concentration which would occur and tend to encourage fracture of the graphite if the corners of the counterbore were sharp. The bottom or corners of the rear counterbore 33 which accommodates the shoulder portion or stop element 19 on the stem are also rounded for the reasons just given.

Target 17 comprises a disk of graphite that has a planar or flat rear face 34 in this particular design. Its front face 35 which contains counterbore 31 is beveled and is coated with a heavy metal alloy layer 36 on which the electron beam from the cathode of the x-ray tube is focused for generating an x-ray beam. Typically, the focal track layer will be composed of an alloy consisting of about 90% tungsten and 10% rhenium bonded on the graphite substrate.

Washer 29 can be composed of any metal that can withstand the temperatures existing in the graphite target when it is heated by making x-ray exposures. As is the case with any component used in the hot high vacuum environment within an x-ray tube, washer 29 should be composed of a metal that has low vapor pressure at high temperatures and, in this case, it should have a melting point above temperatures on the order of 1250° C. or higher that exists in a graphite target x-ray tube. Tantalum has been used for the washer 29 in an actual embodiment. One reason for interposing washer 29 between annular bearing area or land 28 of nut 26 and annular bearing surface 30 in the counterbore of the graphite target is to distribute compressive stress uniformly to obviate development of any overstressed points that might result from irregularities in the graphite surface 30. A high point could act as a crack initiation site if overstressed by tightening of the nut.

Figure 3:
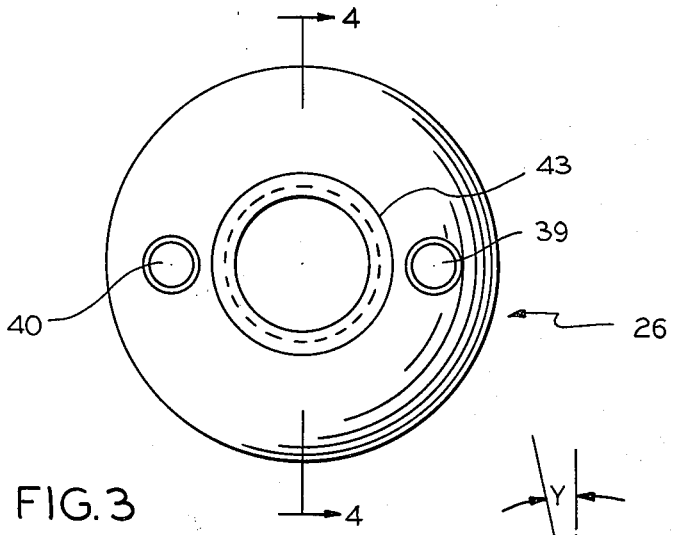
FIG. 3 is a front view of the new clamping nut per se.
Figure 4:
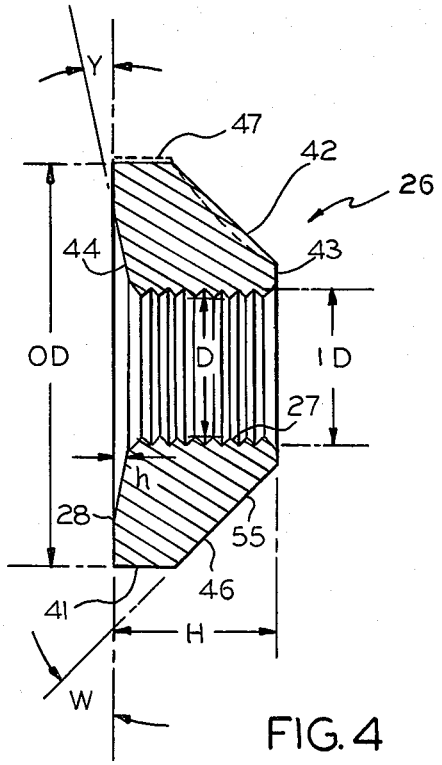
FIG. 4 is a section taken on a line corresponding with 4—4 in FIG. 3.
Figure 5:
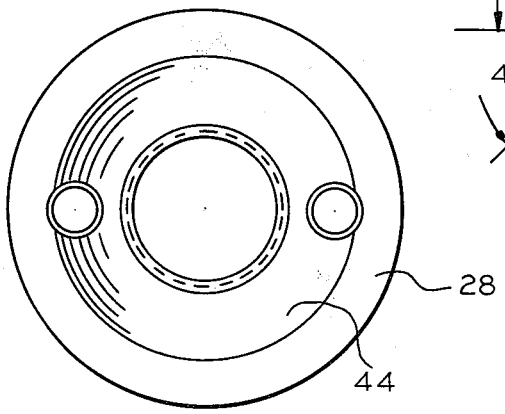
FIG. 5 is a rear view of the clamping nut.

The front end view of nut 26 is shown in FIG. 3 and an axial section of the nut is shown in FIG. 4. As is evident in FIG. 3, the nut has two through holes 39 and 40 which are for engaging it with a spanner wrench, not shown, for tightening it onto the thread 25 of the target supporting stem. The threads should be staked after tightening. A rear view of the target clamping nut 26 is shown in FIG. 5.

The nut serves the purpose of a clamping nut and of a unitary belleville spring washer as well. Its design is based on data for designing belleville springs set forth in "Transactions of American Society of Mechanical Engineers," May 1936, Volume 58, No. 4, by Almen and Laszlo.

Referring to FIG. 4, one may see that the nut comprises a metal body that has a cylindrical portion 41 which extends from the annular land 28 on its rear face over part of its axial length. The exterior of the nut beyond cylindrical portion 41 is convex or tapered, actually conically shaped in this embodiment, as in the region marked 42. The front end of the nut has a rim 43 at which the conical exterior terminates. The overall height of the nut, that is, its dimension from the rim 43 to the annular planar land 28 is indicated by the letter H. The mean diameter of its internally-threaded central hole is indicated by the dimension D. W is the angle between conical surface 42 and a plane to which the axis of the nut is perpendicular. The maximum diameter of the threaded hole is the dimension ID. The outside diameter of the cylindrical portion 41 has the dimension OD. The rear end of the nut is basically concave or dished or, as in this example, conical as defined by the angular surface 44. The acute angle between this surface 44 and a transverse plane to which the axis of the nut is perpendicular is designated by the angle Y. A significant dimension is the maximum depth of the conical recess at the rear of the nut. This depth is indicated as the "h" dimension. The angle between exterior beveled surface 42 and the transverse plane is substantially greater than the angle between the surface 44 and the plane such that the axial thickness of the nut is greatest in the region surrounding the thread and decreases radially outwardly from the thread. Any cross-section of nut 26 as viewed in FIG. 4, for example, constitutes a beam that is stiffest in its axially thick region 45 and becomes more flexible in the radially outward direction to a region of maximum flexibility marked 46. It will be evident that when the nut is tightened, it will deform and assume a shape which is somewhat exaggerated but is generally of the form indicated by the dashed line 47. Of course, the overall height dimension H also diminishes slightly when the nut is tightened. Thus, when the thread 27 nut is tightened onto the thread 25 of the target supporting stem, the nut deflects somewhat like a belleville spring and stores energy that tends to restore it to its unstressed height H. In one actual embodiment that uses TZM for the nut and stem, by way of example and not limitation, where the thread is a nominal ⅜ inch in diameter and there are twenty-four threads per inch, a tightening torque of about 20 footpounds results in total load P in the axial direction of about 1280 pounds. The deflection or change in concavity depth h was about 0.005 inch. The height H of the nut before tightening was 0.4 inch and after tightening it was 0.395 inch approximately so there was about 0.005 inch change in height when the nut was at room temperature and predeflected. With a total force P of about 1280 pounds resulting from the torque, and with an annular land 28 area of about 0.27 square inches, a compressive unit stress of about 4,740 pounds per square inch is imposed on the graphite and a stress of about 56,000 psi is developed in the TZM stem at room temperature. It is calculated that when the graphite target and TZM stem temperatures are at about 1200° C., the stress in the nut is about 30,000 psi, deflection of the nut remains the same and the total load P imposed by the nut on the graphite target is still at near 680 pounds. After several thousand cycles of heating the target to over 1200° C. for five minutes and cooling to near room temperature repeatedly, the height H was still below 0.4 inch showing that it compensated for the contraction resulting from cooling the graphite and for the permanent plastic deformation or creep of the stem in the region of its threads. A torque of 10 foot-pounds was required to loosen the nut.

In the one actual embodiment of the creep resistant nut, the graphite target disk is about one inch thick and has an outside diameter of four inches. The TZM nut has a thread diameter (ID) of ⅜ inch. H=0.40 inch; Angle Y=14.5°; Angle W=44°; OD=0.96 inch; the inside diameter of annular and flat land 28 is 0.760 inch and the axial length of cylindrical portion 41 is 0.15 inch; and h=0.050. The total area of annular land 28 is about 0.27 $in^2$.

As indicated earlier, the new specially configured nut can be used to great advantage for clamping a target disk made of metal as well as graphite, such as tungsten and molybdenum and alloys of these metals, to a metal rotating anode stem. A typical metal target with which the nut may be used is illustrated in U.S. Pat. No. 4,132,916 which is owned by the assignee of the invention described herein. When used to clamp a metal target it is also necessary to be sure that the torque applied to the nut initially does not result in exceeding the yield strength of either the nut or stem metal at room temperature and the thermal creep strength of the metal at the high temperature it will reach when the x-ray tube is operating.

Information for desining a TZM nut in accordance with the invention for use on a TZM stem with a graphite or metal target, is based on the previously cited source and is set forth in more detail to indicate the general procedure for any choice of metals as follows:

Symbols:

P=Load in pounds.
δ=Deflection in inches.
t=Thickness of material in inches.
h=Free height minus thickness in inches.
a=One-half outside diameter in inches.
E=Young's modulus for TZM at 20° C. is $46\times10^6$ and at 1100° C. is $25\times10^6$.
f=Stress at inside circumference.
k=ratio of OD/ID.
v=Poisson's ratio.

M, $C_1$ and $C_2$ are constants which can be calculated from the following formulas:

Best Available Copy $$M = \frac{6}{\pi \log_e k} \frac{(k-1)^2}{k^2}$$

$$C_1 = \frac{6}{\pi \log_e k}\left[\frac{(k-1)}{\log_e k} - 1\right]$$

$$C_2 = \frac{6}{\pi \log_e k} \frac{(k-1)}{2}$$

The deflection-load formula, using these constants is:

$$P = \frac{E\delta}{(1-\nu^2)Mk^2}\left[\left(h - \frac{\delta}{2}\right)(h-\delta)t + t^3\right]$$

The stress formula is as follows:

$$f = \frac{E\delta}{(1-\nu^2)Mk^2}\left[C_1\left(h - \frac{\delta}{2}\right) C_2 t\right]$$

The coefficient of expansion of graphite is approximately $4.6\times10^{-6}$ in/in/°C. and for TZM is $5.6\times10^{-6}$ in/in/°C.

It also is within the purview of the invention to modify the nut, such as nut 26 in FIG. 4, by providing it with a smooth central bore instead of having the threads 27 in the bores in which case element 26 could be characterized as a belleville washer. The bore would then be fit over the anode stem with as little clearance as possible and put under compressive stress with a separate nut, not shown, that would turn on to stem thread 25 or an extension thereof. Of course, the part of the stem that has thread 25 would be a smooth cylinder of proper diameter for matching the belleville washer bore. The threads on the nut and stem should be staked after the separate nut is tightened. If a separate nut is used with the belleville washer, the metal of the anode stem and washer should be similar preferably but the nut may be of different metal and could resemble a common or conventional nut.

Although a preferred implementation of the new target attachment concept has been described in detail, such description is intended to be illustrative rather than limiting, for the concept may be variously implemented and is to be limited only by construing the claims which follow.

We claim:

1. An x-ray tube including a rotating anode having an axially extending metal stem, the stem having a threaded end portion and a stop element axially spaced from the end portion, a target disk having a central hole for positioning it on the stem with its rear abutting the stop element and with the threaded portion of the stem accessible from the front of disk, and thermal creep resistant means for clamping the disk on the stem, said means comprising:

a body having a central axially extending hole, the front end of said body having a generally convex shape and the rear end having a generally concave shape, the concavity having an outside diameter less than the outside diameter of said body to thereby define a planar annular land surrounding the concavity and presented toward the rear of the body for transmitting compressive force to the target, the amount of convexity being greater than the amount of concavity such that the axial thickness of the body is greatest in the region surrounding the central hole and said axial thickness decreases radially outwardly from said hole, and means cooperating with the thread on the stem to compress said body axially and predeflect said body to develop a force in it for clamping the target on the stem, the amount of predeflection being sufficient for some deflection and corresponding clamping force to remain and counteract the effect of thread creep resulting from thermal cycling of the target and stem.

2. The x-ray tube as in claim 1 wherein said means for cooperating with the thread on the stem is a thread in the hole of said body that is engaged with the thread on the stem, whereby rotation of said body in a direction that advances the body toward the target will effect predeflection.

3. The x-ray tube as in any of claims 1 or 2 wherein said target comprises a substrate composed of a selected one of metal or graphite.

4. The x-ray tube as in any of claims 1 or 2 wherein said body and stem are composed of a material selected from the class consisting of TZM, TZC, zirconium, molybdenum, molybdenum-tungsten alloy, tantalum, tantalum-tungsten alloy, tungsten-rhenium alloy and molybdenum-rhenium alloy.

5. The x-ray tube as in any of claims 1 or 2 wherein said body and stem are composed of TZM.

6. An x-ray tube including a rotating anode having an axially extending metal stem, the stem having a threaded end portion and a stop element axially spaced from the thread, an x-ray target disk having a central hole for positioning it on the stem with its rear abutting the stop element and with the threaded portion of the stem accessible from the front of disk, and a metal nut for clamping the disk on the stem, said nut comprising:

a cylindrical nut body having a central axially extending threaded hole, the front end of said body having a generally convex shape and the rear end having a generally concave shape, the concavity having an outside diameter less than the outside diameter of said cylindrical body to thereby define a planar annular land surrounding the concavity and presented toward the rear of the body, the amount of convexity being greater than the amount of concavity such that the axial thickness of the body is greatest in the region surrounding the thread and said axial thickness decreases radially outwardly from said thread, so the nut will predeflect when it is tightened on said threaded stem for clamping said target, the amount of predeflection being sufficient for some deflection and corresponding clamping force to remain and counteract the effect of thread creep resulting from thermal cycling of the target, stem and nut.

7. The x-ray tube as in claim 6 wherein:

said target is comprised of a graphite substrate and has a counterbore in its front end concentric with its axial hole, the bottom of said counterbore having a frontwardly projecting annular planar region, the inside and outside diameter on said annular region corresponding substantially to the inside and outside diameters of the rearwardly presented annular land on the nut.

8. The x-ray tube as in claim 7 including a thin metal washer interposed between said annular planar region on the target and the annular land on the nut.

9. The nut body as in claim 6 provided with at least two axial holes radially spaced from the threaded hole in the nut for permitting the nut to be engaged with a spanner wrench to tighten it.

10. The x-ray tube as in any of claims 6, 7, 8 or 9 wherein said nut body and stem are composed of TZM.

11. The x-ray tube as in any of claims 6, 7, 8 or 9 wherein said nut body and stem are composed of a material selected from the class consisting of TZM, TZC, zirconium, molybdenum, molybdenum-tungsten alloy, tantalum, tantalum-tungsten alloy, tungsten-rhenium alloy and molybdenum-rhenium alloy.

12. An x-ray tube including a rotating anode having an axially extending stem composed of TZM alloy, the stem having a threaded end portion and a stop element axially spaced from the thread, a graphite target disk having a central hole for positioning it on the stem with its rear abutting the stop element and with the threaded portion of the stem accessible from the front of disk, and a nut composed of TZM alloy for clamping the disk on the stem, said nut comprising:

a cylindrical nut body having front and rear ends and a central axially extending threaded hole, said body having an exterior beveled surface sloping from its front end towards its rear end, said rear end having a planar annular rearwardly presented land, and a beveled recess within said land, the surface of said recess sloping from the inside diameter of the land towards said threaded hole, the angle between the exterior beveled surface and a plane transverse to the axis of said hole being greater than the angle of the surface of said recess and said plane such that the axial thickness of the body is greatest in the region surrounding the thread and decreases radially outwardly from the thread, so the nut will predeflect when it is tightened on said threaded stem for clamping said target, the amount of predeflection being sufficient for some deflection and corresponding clamping force to remain and counteract the effect of creep resulting from the thermal cycling of the target, stem and nut.

13. The x-ray tube as in claim 12 wherein:

said graphite target has a counterbore in its front end concentric with its axial hole, the bottom of said counterbore having a frontwardly projecting annular planar region, the inside and outside diameter on said annular region corresponding substantially to the inside and outside diameters of the rearwardly presented annular land on the nut.

14. The x-ray tube as in claim 13 including a thin metal washer interposed between said annular planar region on the target and the annular land on the nut.

15. The nut as in claim 12 provided with at least two axial holes, radially spaced from the threaded hole in the nut, for permitting the nut to be engaged with a spanner wrench to tighten it.

* * * * *